United States Patent [19]

Epitaux

[11] Patent Number: 4,860,595

[45] Date of Patent: Aug. 29, 1989

[54] APPARATUS FOR ADJUSTING A SAFETY SKI BINDING

[76] Inventor: Jacques Epitaux, Route de Genéve 82, 1004 Lausanne, Switzerland

[21] Appl. No.: 227,294

[22] Filed: Aug. 2, 1988

[30] Foreign Application Priority Data

Aug. 11, 1987 [CH] Switzerland ..... 3090/87

[51] Int. Cl.[4] ..... G01L 5/03

[52] U.S. Cl. ..... 73/862.02

[58] Field of Search ..... 73/862.02, 862.35, 862.23, 73/862.26

[56] References Cited

U.S. PATENT DOCUMENTS 3,192,767 7/1965 Outwater .
3,572,105 3/1971 Kaehler .
3,805,603 4/1974 Ettlinger ..... 73/862.02
4,637,263 1/1987 Fritz et al. ..... 73/862.04

FOREIGN PATENT DOCUMENTS 378688 9/1985 Austria .
2660055 4/1979 Fed. Rep. of Germany .
637212 7/1983 Switzerland .

*Primary Examiner*—Charles A. Ruehl
*Attorney, Agent, or Firm*—Oliff & Berridge

[57] ABSTRACT

A bar makes it possible to apply either torsional stress or bending stress. In the case of torsional stress, an element is coupled to a stress-transmission bar which is rigidly connected to an artificial foot inserted in a ski boot. A strain gauge co-operates with a counterpart gauge for measuring the stresses applied and in particular the thresholds of release of the ski binding, which are compared with norm values processed in a circuit on the basis of data relative to the skier, entered beforehand.

11 Claims, 3 Drawing Sheets

Figure 1:
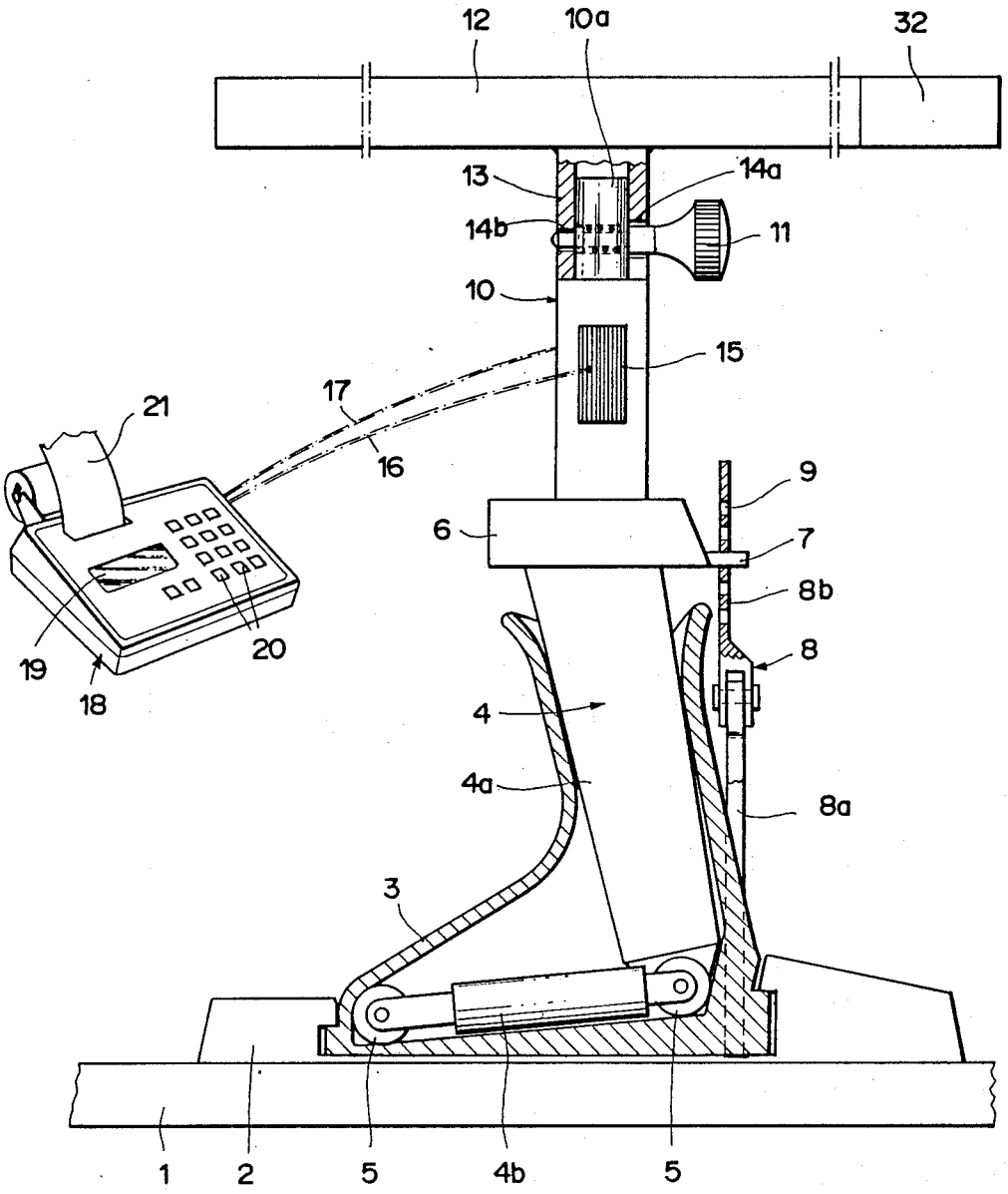

FIG. 2
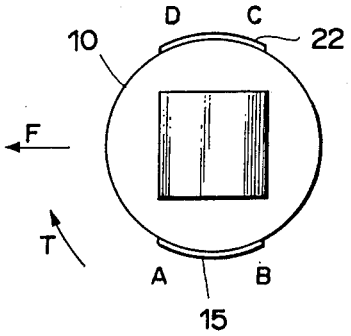
FIG. 3
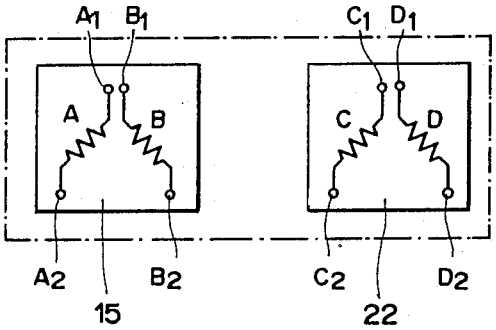
FIG. 4A
Torsion
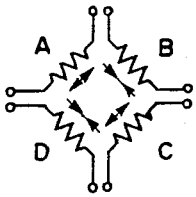
FIG. 4B
Bending
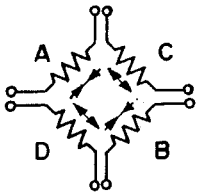
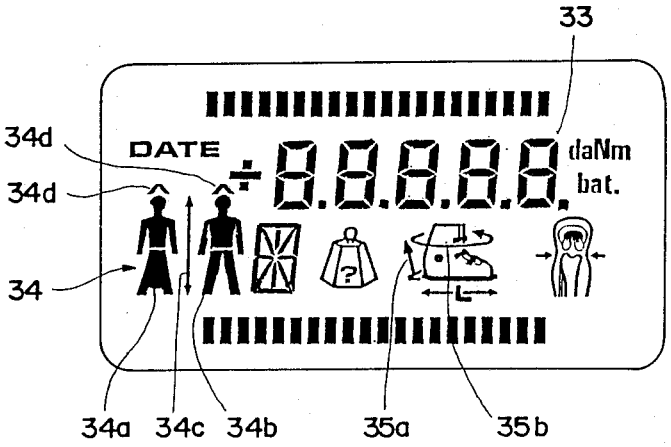
FIG. 8

APPARATUS FOR ADJUSTING A SAFETY SKI BINDING

This invention relates to sports equipment, and more particularly to apparatus for adjusting a safety ski binding, of the type having a support for the ski, an artificial foot intended to be introduced and fixed in a ski boot mounted in the ski binding and including an upright, a stress-applying device acting upon the upright of the foot, and a stress-measuring device.

Swiss Patent No. 637,212, in particular, discloses apparatus for adjusting a safety binding mounted on a ski, by means of which various types of loads or stresses can be applied to an artificial foot fixed rigidly to the ski boot and the release threshold of the binding measured for each of these types of stresses.

Previously, U.S. Pat. Nos. 3,192,767 and No. 3,572,105, in particular, had already described apparatus comprising an artificial foot intended to be introduced into the ski boot and acted upon by means such as a torque wrench or a set of such wrenches for exerting forces on this foot and measuring their value at the moment of release.

Austrian Patent No. 378,688 further teaches apparatus which likewise comprises an artificial foot intended to be fixed rigidly to the ski boot. This foot is rigidly coupled to a load-applying device having an elastically deformable transmission device and equipped with one or more strain gauges. These gauges are connected to circuits such as measuring units, allowing the stresses applied to the artificial foot, and consequently to the ski boot, to be checked.

However, the accuracy and ease of operation of these various apparatus are very inadequate for meeting present requirements.

The installations hitherto proposed for checking the adjustment of safety ski bindings accurately, with the assistance of an electronic measuring system, are very bulky and expensive. They require particular attention for positioning the binding, or the ski and ski boot.

It is therefore an object of this invention to provide improved apparatus for adjusting safety ski bindings which, while compact and handy to use, permits carrying out the necessary checks accurately, reliably, and completely.

Another object of this invention is to provide such apparatus wherein the stress-applying device is of a multi-purpose manual type and the measuring device can easily be switched over to supply the results of successive measurements in various stress-application modes.

To this end, in the apparatus for adjusting safety ski bindings according to the present invention, of the type initially mentioned, the measuring device comprises, on the one hand, an elongated stress transmission element capable of undergoing resilient deformations as a function of the stresses transmitted, having one end integral with the upright and one end formed as a coupling part, and on the other hand, means for measuring the aforementioned deformations, switchable as a function of a stress mode freely chosen among several different modes, and the stress-applying device comprises means capable of causing stresses to act selectively upon the coupling part according to the different stress modes.

Figure 5:
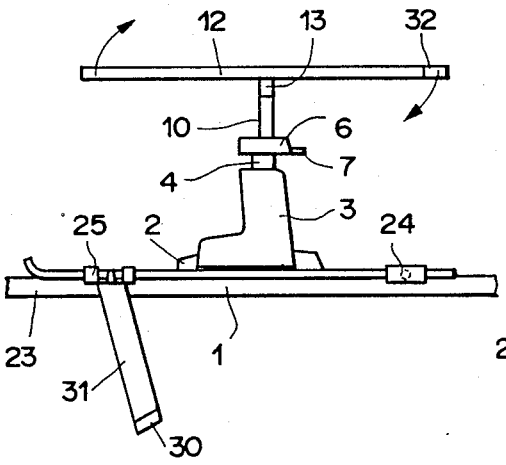
Figure 6:
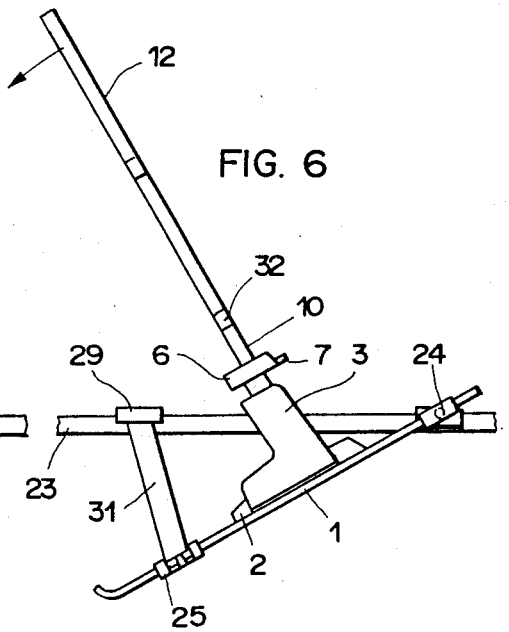
Figure 7:
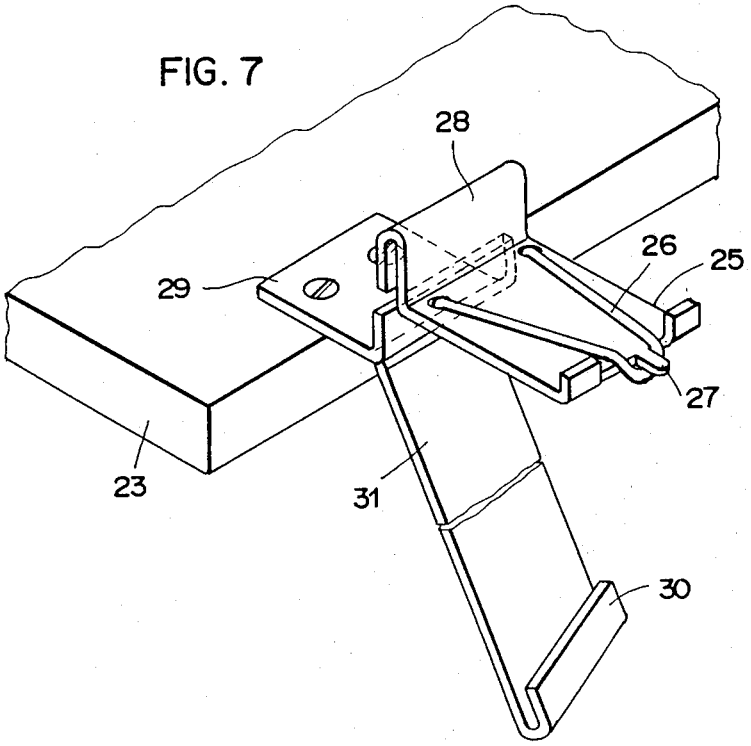

A preferred embodiment of the invention will now be described in detail with reference to the accompanying drawings, in which:

FIG. 1 is a diagrammatic view, partially in section, of the apparatus as a whole arranged for carrying out a first mode of stress or strain application, FIG. 2 is a top plan view of the stress-transmission bar showing the location of the strain gauges, FIG. 3 is a developed elevation showing the arrangement of the strain gauges, FIGS. 4A and 4B are diagrams of the precision resistors showing the deformations undergone in two stress-application modes, FIG. 5 is a small-scale elevation showing the mounting of the apparatus for measuring a torsional moment, FIG. 6 is a view analogous to FIG. 5 showing the mounting of the apparatus during measurement of a front deflection, FIG. 7 is a perspective view showing the hooking of a free attachment part, and FIG. 8 is a view of the display field forming part of the case of the measuring device.

FIG. 1 shows the elements which co-operate for facilitating use of the apparatus and ensuring the accuracy of the measurements. A ski 1 is fixed to a support (23, FIGS. 5–7) in a horizontal position by means to be described below. Fitted in a ski binding 2 is a ski boot 3 into which there is inserted an artificial foot 4 comprising a rigid upright 4*a* and a telescopic base 4*b* hinged to the bottom of upright 4*a*, the joint and the front end of base 4*b* being provided with rollers 5 so that foot 4 precisely fits the interior of ski boot 3. At the top of upright 4 there is a connection piece 6 with a hooking pin 7 projecting toward the rear. A strap 8 comprising a loop 8*a* in the lower part and at the top a metal strip 8*b* with holes 9 fits under the heel of ski boot 3 and may be tightened so that one of the holes 9 engages pin 7. Foot 4 is thus made absolutely integral with ski boot 3.

Fixed on connector 6 is a measuring unit comprising a stress-transmission bar 10. This essential element of the design being described is a section of a perfectly homogeneous cylindrical metal bar, preferably steel, machined so as to undergo regular resilient deformations in the event of application of stresses or strains. This cylindrical bar is fixed, e.g., by welding, across element 6 and extends vertically upward. At the top, it has a connection element 1O*a* of square or rectangular cross-section. Mounted in a transverse hole in connector 10*a* is a locking device 11, e.g., of the type comprising a button actuating a rod inserted in connector 10*a*, provided with a snug and retained by a spring.

As may also be seen from FIG. 1, a rectangular stress-applying bar 12 comprises midway along its length a first coupling element 13 in the shape of a section of square or rectangular tubing fitted to the dimensions of connection element 10*a*. This section of tubing extends perpendicular to bar 12. A similar section 32 likewise extends from one end of bar 12, as a continuation thereof, forming a second coupling element for connecting bar 12 to transmission element 10. Each of the sections of tubing 13 and 32 includes on one side a hole 14 and on the other side a keyhole-shaped slot 14*a*, these means being capable of co-operating with locking device 11 so that coupling element 13 or 32 may easily be connected to connection element 1O*a*. This locking arrangement keeps the ski boot from escaping after release of the binding.

FIG. 1 also a strain gauge 15 cemented to the cylindrical face of transmission bar 10. A corresponding gauge 22 is cemented in a position diametrically opposite to gauge 15, and these two gauges 15 and 22 are connected by conductors 16 and 17 to a measuring device 18 accommodated in a case, the face of which comprises a display field 19 and a keyboard 20. Device 18 is further provided with a printer and means for producing a strip of paper 21 with indications confirming the results of the measurements.

FIGS. 2, 3, 4A and 4B illustrate the arrangement and possible connections of strain gauge 15 and the counterpart gauge 22. As already explained, these gauges are cemented in symmetrical positions against the cylindrical face of transmission bar 10 and, as shown in FIG. 3, they comprise together four resistors A, B, C, D which, in each gauge, are inclined at an angle of 45° in opposite directions. Resistors A–D are connected by leads 16 and 17 to the measuring circuit in case 18 in such a way that they may be hooked up in different ways, the switchover being effected by manual control contacts, as will be seen below. FIG. 4A and 4B show how resistors A, B, C, D are disposed in the measuring circuit and what deformations they undergo when bar 10 is subjected to torsional stress about its axis, on the one hand, and to bending stress in a direction perpendicular to the diametrical plane passing through the centers of gauges 15 and 22, on the other hand. In the case of torsional stress according to arrow T in FIG. 2, resistors A and C become longer, while resistors B and D contract. Resistors A and D will therefore be connected in series, as will resistors B and C, and the voltage fluctuations of these two series connections will be compared. In the case of bending stress according to arrow F in FIG. 2, on the other hand, resistors C and D become longer, whereas resistors A and B contract. Commutation of the connections will therefore take place accordingly in order to be able to add the voltage fluctuations going in the same direction and to compare them to the voltage fluctuations going in the other direction.

Thus, the same stress-transmission bar 10, rigidly integral with the foot 4, is used for two modes of application of different stresses or strains.

FIGS. 5, 6, and 7 show how these two stress-application modes are carried out. In the case of FIG. 5, ski 1 is fixed to a support 23 in a horizontal position so that stress-transmission bar 10 juts up vertically above it. Bar 12 is connected to coupling section 1O*a*, as has been seen in FIG. 1, i.e., via its coupling element 13 situated midway along its length, so that torsional stress sufficient to ensure the release of binding 2 can be exerted on bar 12 manually or with the aid of a jack. Ski 1 is fixed to rigid support 23 by a securing mechanism comprising a rear attachment part 24 and a front attachment part 25. Part 25 is shown in detail in FIG. 7. It is seen to comprise a plate intended to be placed under the sole of ski 1 and equipped with an elastic strap 26 which hooks on a stud 27. Plate 25 is provided with a front rim and with a rear hooking part 28. Attachment part 24 is made up quite similarly to part 25; but instead of having an inverted U-shaped hooking part at its rear edge, the plate of part 24 is mounted on a bearing which pivots on a fixed journal, integral with support 23 and oriented horizontally perpendicular to the direction of ski 1 in FIG. 5. Moreover, as may be seen from FIG. 7, attachment part 25 may be hooked on an angle bracket 29 fixed to support 23 at the same level as the pivoting attachment part 24. It may also be hooked on a rim 30 made at the bottom of a blade 31 extending downward from support 23. This mechanism thus allows ski 1 to be placed either in the horizontal position shown in FIG. 5, in which case attachment part 25 engages angle bracket 29, or in an inclined position as may be seen in FIG. 6, where part 25 then engages rim 30 of element 31. Between these two positions, attachment part 24 has pivoted about its journal.

In the position illustrated in FIG. 6, stress-transmission bar 10 is directed upwardly in a slightly inclined position, and bar 12 is connected to coupling section 1O*a* by its coupling element 32, situated at one of its ends. In this position, as may be seen in FIG. 6, it is possible to exert on bar 10 a bending stress which simulates a forward fall and should cause the release of the ski binding at a threshold value such that the skier remains uninjured.

The apparatus described makes it possible to adjust every safety binding competently and efficiently as a function of objective norms. It s well known that by means of studies, norms have been determined corresponding to the strains to which the legs of a skier may be subjected in cases of maximum stress, e.g., a torsional stress or a bending stress corresponding to a forward fall or likewise to a fall backward. These limiting values have been established as a function of complex personal data such as sex, height, weight, age, and—in certain cases—the dimensions of the tibia in diameter or possibly still other characteristics. In order to ensure quick and simple determination, the measuring circuit provided in case 18 comprises a memory and a processor capable of processing the values of the norms as a function of data entered into the circuit. This processor likewise compares the values of the norms to the measurement results and carries out the acknowledgment of the result. For that purpose, there is provided on the cover of the case a display zone 19 which is equipped not only with a number of display positions 33, representing figures and giving the values of the moments of force, but also with various symbols 34 facilitating the program cycle of entering data and measurements. It is not necessary to explain the significance and function of all the symbols here. It will be recognized that symbols 34*a* and 34*b* are connected to contacts and instruct the user to enter the sex of the skier, symbol 34*c* to enter his or her height, 34*d* to enter the skier's age, etc. The circuit comprises a program which controls the blinking of these various symbols as a signal to the user to enter the corresponding data, the various symbols being energized successively in the order in which the program should proceed and being interrupted when the appropriate information has been entered. It will be understood in particular that arrows 35*a* and 35*b* are connected to control contacts for switching over strain gauges 15 and 22 as a function of the stress-application mode to be carried out.

Thus, the apparatus described above makes it possible to test a safety binding and to correct its adjustment under conditions which are both simple and accurate, while taking up a minimum of space. Owing particularly to the fact that the stress-application device comprises bar 10, which is rigidly fixed to the top of foot 4 and which is equipped with gauges 15 and 22, various modes of application may be carried out successively under conditions of good reliability since the same gauges carry out the measurement in the different cases.

Finally, it will be noted that the conditions of a backward fall may be very easily produced by reversing the position of the ski as compared with that shown in FIG. 6. If need be, other stress-application modes might equally well be carried out.

What is claimed is:

1. Apparatus for adjusting a safety ski binding, comprising:

a support with means for rigidly fixing a ski to said support.

A foot-simulating device intended to be introduced and fixed in a ski boot mounted in a ski binding which belongs to said ski, said device including an upright, means for applying stress to said upright according to a plurality of different stress modes, said means for applying stress to said upright comprising:

an elongated stress-transmission element having a first end integral with said upright, a second end formed as a coupling part and a central portion between said ends, arranged for undergoing resilient deformations as a function of said stresses applied to said upright; and a stress creating means connectable to said coupling part according to a plurality of different ways for imparting stresses to said upright in different ranges corresponding to said different stress modes, said stresses imparting to said central portion, in each of said stress modes, resilient deformations in a corresponding range of deformations;

and said apparatus further comprising measuring means including means for commutation between a plurality of functioning modes, each of which corresponds to another one of said stress modes, and able in each functioning mode to provide information on the stresses applied to the upright, said information being responsive to measurements by said measuring means of the deformations imparted to said central portion in the corresponding stress mode.

2. The apparatus of claim 1, wherein said means for applying stress comprise a multi-purpose stress-applying component including a plurality of coupling elements, said apparatus further comprising means for connecting said coupling elements selectively to said coupling part as a function of the selected one of said stress modes.

3. The apparatus of claim 2, wherein said multi-purpose stress-applying component is a rigid bar, a first one of said coupling elements being situated midway along the length of said bar and a second one of said coupling elements being situated at one end of said bar, said bar constituting a manually-actuated lever for applying a torsional force or a bending force to said stress-transmission element.

4. The apparatus of claim 2, wherein said coupling part comprises a resilient locking means co-operating with said multi-purpose stress-applying component, whereby said foot-simulating device remains connected to said multi-purpose stress-applying component after release of said ski binding.

5. The apparatus of claim 2, wherein said measuring means comprise a set of strain gauges cemented to the surface of said stress-transmission element, a measuring circuit, means connecting said gauges to said measuring circuit, and means for commutation of said means connecting said gauges to said measuring circuit according to a plurality of diagrams corresponding to said stress modes.

6. The apparatus of claim 5, wherein said measuring circuit comprises means for processing signals corresponding to the measured values of the stresses at the time of release of said ski binding and for comparing said measured values with norm values processed from memorized data and as a function of the chosen said stress mode.

7. The apparatus of claim 6, wherein said measuring means comprise a keyboard for entering data, a display field provided with symbols connected to said measuring circuit, and an incorporated measuring program for energizing said symbols in a predetermined order, whereby successive data may be entered into said circuit by means of said keyboard for determining said norm values with which said measured stress values are to be compared.

8. The apparatus of claim 7, wherein said symbols and said keyboard comprise means for successively selecting two said diagrams for connecting said gauges corresponding to two said stress modes, said modes being torsion and bending.

9. The apparatus of claim 1, wherein said support is arranged for supporting said ski rigidly both in a horizontal position and in an inclined position.

10. The apparatus of claim 9, wherein said support comprises an attachment part pivoting about a horizontal axis and including means for fixing a first sole zone of said ski to said attachment part, and a free attachment part arranged for being made integral with a second sole zone of said ski and including a hooking means, said support further comprising two fixed. superposed hooking elements for co-operating with said hooking means of said free attachment part, whereby said ski may be immobilized either in a horizontal position or in an inclined position.

11. The apparatus of claim 1, further comprising a projecting pin and a boot-fixing strap having a loop fitting under the heel of said ski-boot and a metal blade including a plurality of holes for hooking said blade to said pin.

* * * * *